US006737972B1

(12) United States Patent
Gitlis

(10) Patent No.: US 6,737,972 B1
(45) Date of Patent: May 18, 2004

(54) VIBRATION SENSOR

(75) Inventor: Meir Gitlis, Bnei Atarot (IL)

(73) Assignee: Integrated Detection Systems, Herzliyya Pituah (IL)

( * ) Notice: Subject to any disclaimer, the term of this patent is extended or adjusted under 35 U.S.C. 154(b) by 0 days.

(21) Appl. No.: 10/290,853

(22) Filed: Nov. 8, 2002

(51) Int. Cl.[7] ..... G08B 13/00

(52) U.S. Cl. ..... 340/566; 340/689; 340/541; 200/61.45 R; 73/652

(58) Field of Search ..... 340/545.1, 546, 340/547, 548, 541, 689; 200/61.45 R, 566, 429, 540, 545.5, 565; 73/652, 514, 1.38

(56) References Cited

U.S. PATENT DOCUMENTS 3,706,867 A * 12/1972 Rand et al. ..... 200/61.52
4,212,208 A * 7/1980 Weale et al. ..... 73/652
6,087,936 A * 7/2000 Woods ..... 340/566
6,089,092 A * 7/2000 Shinohara et al. ..... 73/514.01
6,215,396 B1 * 4/2001 Script ..... 340/545.1

* cited by examiner

*Primary Examiner*—Anh V. La
(74) *Attorney, Agent, or Firm*—Skadden, Arps, Slate, Meagher & Flom LLP

(57) ABSTRACT

A vibration sensor is used in conjunction with perimeter security systems. The sensor is comprised of two conductive spherical elements each resting on a pair of parallel conductive arcs. A plurality of sensors are attached to mounting device and placed at spaced intervals on a security fence. The sensors are used to detect persons who attempt to cut, climb, lift, or contact the security fence.

12 Claims, 7 Drawing Sheets

VIBRATION SENSOR

FIELD OF THE INVENTION

The present invention relates to security devices, and more particularly to motion sensing apparatus for use in a perimeter intrusion detection system.

BACKGROUND OF THE INVENTION

It is quite common to employ a wire fence as a barrier surrounding an area to be protected. Various devices have been employed to provide a warning if any attempt is made to interfere with the protective function of the fence. A number of these intrusion detection systems, particularly those protecting large-scale high security facilities, typically provide a combination of a physical barrier and an electronic detection capability. Often times, sensing devices of the type described herein are used to detect persons who attempt to cut, climb, lift, or contact the fence. Vibration sensors are one type of such devices. In a typical implementation, at least one vibration sensor is mounted on a fence section such as a chain link fence segment. When an intruder contacts the chain link fence, the vibrations are transmitted to the sensor and detected. A control station receives the vibration indication and generates a corresponding alarm condition.

However, these prior art vibration sensing systems suffer from a number of disadvantages. Primary among these is the extreme difficulty of properly aligning the vibration sensor when mounting on the fence. Improper alignment of the sensor can greatly affect its sensitivity, causing it to detect vibration in response to either too little or too great of a force. Additionally, prior art constructions lacked the ability to set the direction of sensitivity for the sensor, which may be required for objects tending to naturally move along one direction, such as fences.

SUMMARY OF INVENTION

Therefore, in accordance with the present invention, a vibration sensor includes a housing and a directional actuator. The actuator includes two pairs of conductive arcs as part of an actuator assembly. Each pair of arcs includes one smooth and one irregularly shaped arc. Two movable conductive spherical elements normally rest in contact with each pair of arcs, respectively, and thus produce an electrical interconnection therebetween. In operation, in response to the application of predetermined force to the actuator, the two movable conductive spherical elements break contact with at least one of the arcs, thus opening the respective electrical connections. Each pair of conductive arcs is coupled to a logic circuitry processing unit for sensing the interruption in the electrical interconnection and determining in response thereto whether an alarm condition should be reported.

The actuator assembly is located inside an actuator cover, which is divided into two atmospheres, each containing a pair of conductive arcs and a movable conductive spherical element. The actuator cover is placed inside an ellipse-shaped sensor cover made up of two halves. A coupling ring of the cover is inserted into a mounting means, which is attached to a fence. A plurality of such sensors are connected by an electrical cable and placed on a wire fence at spaced intervals between each divided section of the fence. The system therefore protects against attempts of persons to climb, lift, or cut the fence itself.

In one embodiment, the invention provides a vibration sensor employed for detecting movement of a physical barrier that includes a sensor cover and an actuator assembly. The sensor cover includes a coupling portion for coupling the sensor to a physical barrier at a first orientation. The sensor cover is also adapted to secure an actuator assembly in at least one predetermined orientation relative to the level horizontal when the sensor is coupled to the physical barrier at said first orientation. The actuator assembly includes a first pair of conductive arcs and a second pair of conductive arcs, where each pair of conductive arcs is coupled as a corresponding ends of a switch to a control circuit. The first pair of conductive arcs is positioned substantially parallel to the second pair of conductive arcs. The actuator assembly also includes a first conductive sphere and a second conductive sphere. The first sphere rests between and engages each arc from the first pair of conductive arcs to provide an electrical connection between the first pair of conductive arcs while the second sphere rests between and engages each arc from said second pair of conductive arcs to provide an electrical connection between the second pair of conductive arcs. The sensor also includes a control circuit coupled to at least each arc of the first pair of conducive arcs and the second pair of conductive arcs. The control circuit indicates an alarm to a sensor output in response to a break in the electrical connection between arcs of a pair of conductive arcs.

In another embodiment, the invention provides a method for installing a sensor on a physical barrier, the sensor including an actuator assembly adapted to sense vibrational disturbances to the sensor, where the actuator assembly is associated with varying sensitivity to vibrations based on the angular orientation of the actuator assembly relative to the level horizontal. The method includes securing the actuator assembly at an angular orientation relative to a sensor body by employing a securing pin. This securing pin is coupled at a first end to a pivoting anchor and is coupled at a second end to the exterior surface of the sensor body within a channel opening, which allows for displacement of said securing pin second end along said channel. The method also includes rigidly coupling the sensor to the physical barrier. Finally, the method includes adjusting the angular, internal, position of the actuator by adjusting the position of the second end of the securing pin to set the sensitivity of the sensor.

DETAILED DESCRIPTION

The present invention is preferably employed in conjunction with an intrusion detection system of the type that uses wire fences as a physical barrier to guard against entry or contact with certain premises. Although not shown in the Figures, it is understood that a system in accordance with the invention typically includes cables, barbed wire, posts and other components which form parts of an overall intrusion detection system.

Figure 1:
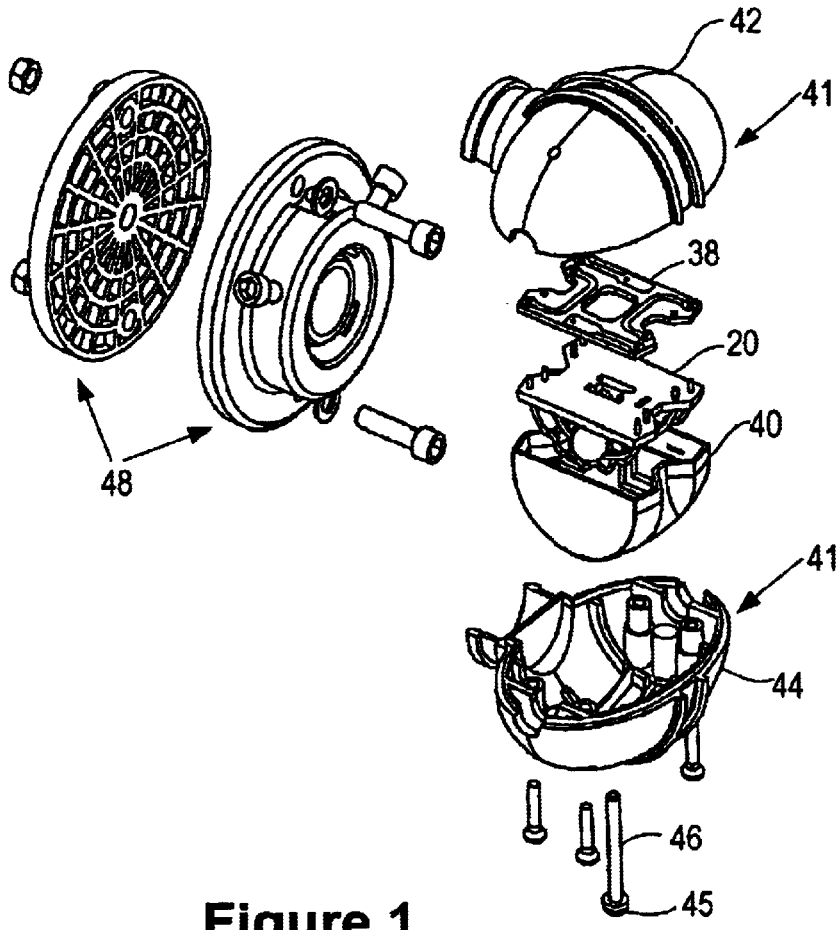
FIG. 1 is an exploded view of the vibration sensor in its preferred embodiment along with the sensor housing and the mounting base.

FIG. 1 illustrates components associated with a vibration sensor 20 in accordance with the present invention. The vibration sensor 41 generally includes a sensor cover, and an actuator. The actuator is adapted to provide an alarm indication in response to detecting movement or vibration. The vibration sensor's housing generally serves to shield the actuator from environmental effects as well as prevent a potential intruder from tampering with the internal elements of the sensor, including the actuator. FIG. 1 illustrates general components of the sensor 41, which are relevant to the description of the present invention. However, as may be appreciated, various other components are associated with the sensor 41 to provide a field operable sensor, including various coupling elements, electronic components, such as communication elements and power management, as well as protective elements such as cover sleeves or heat shields. Hence, it may be appreciated that a field implementation of the vibration sensor 41 in accordance with the invention includes additional components as known to one of ordinary skill in the art.

A sensor cover is made of a first cover portion 42 and a second cover portion 44. An actuator base 38 and an actuator cover 40 are used to contain an actuator assembly 20. A securing pin 46 is used to retain the actuator assembly 20 within the sensor housing cover portions 42, 44. A mounting base 48 is preferably attached to a portion of the fence to be monitored by the sensor. In one embodiment, the sensor 41 is attached to the mounting base 48 to secure the sensor to the monitored fence. In another embodiment the sensor 41 is coupled to the monitored fence without the mounting base 48, but rather by conventional coupling means, such as U-bolts.

Each of the second cover portion 44, actuator cover 40, actuator assembly 20, and actuator base 38, preferably includes a center opening for allowing the securing pin 46 to engage a threading provided within the first cover portion 42. The securing-pin head 45 preferably engages the outside of the second cover portion 44 to secure together the main sensor components.

Figure 2:
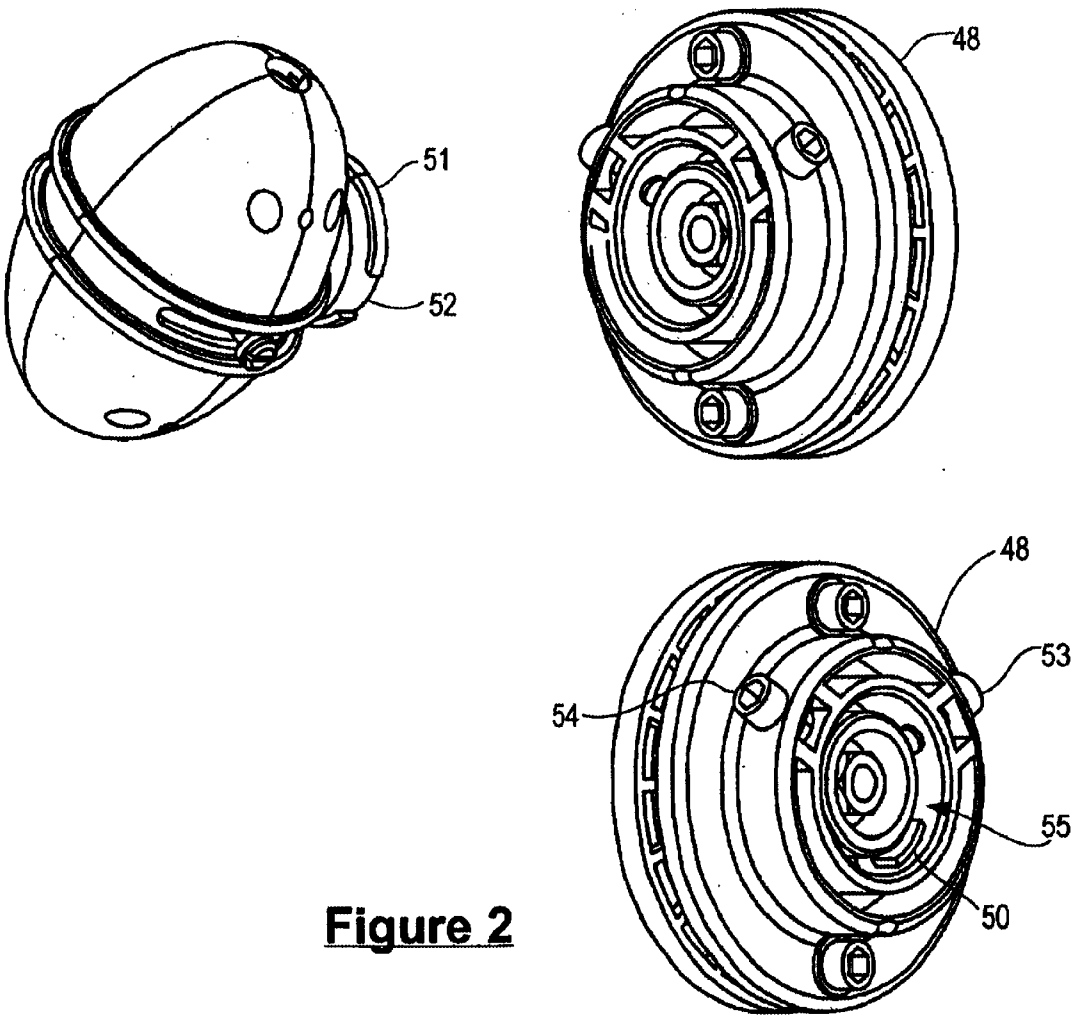
FIG. 2 is an illustration of the method by which the vibration sensor's housing is locked on to the mounting base.

FIG. 2 illustrates the manner by which the sensor 41 is attached to the mounting base in accordance with a security feature of the present invention. The present invention secures the sensor to the mounting base in a manner which prevents a potential intruder from removing the sensor 41 from the mounting base without triggering the actuator to generate an alarm condition. For this purpose, the present invention requires that the sensor 41 is inserted onto or removed from the mounting base 48 at a non-level orientation. The sensor 41 includes a retaining ring 51 that has a bottom, central, opening 52. This opening 52 is adapted to allow for an entry of a tooth 50, which is provided within a coupling channel 55 of the mounting base. The coupling channel tooth 50 is preferably provided at a location which accepts the sensor at a skewed orientation, at a point which is not level, or balanced.

In operation, the sensor 41 is installed within the mounting base 48 by first inserting the retaining ring 51 into the coupling channel 55 at an angle to the horizontal so as to allow for the coupling channel tooth 50 to enter the inner portion of the retaining ring 51. The sensor is then turned to an end position, which is at a level orientation where the retaining ring 51 engages supporting bolts 53, 54 in the coupling channel 55. The sensor actuator is now level and is ready to detect vibrations. As may be appreciated, if a potential intruder attempts to remove the sensor 41 from the mounting base 48, the intruder must turn the sensor away from the level position. As discussed in further detail below, when the sensor is turned away from the level position, the actuator detects such vibration, or movement, and produces a corresponding alarm condition. Accordingly, the present invention provides a sensor 41, which is resistant to tampering by its removal from the monitored fence.

Figure 3:
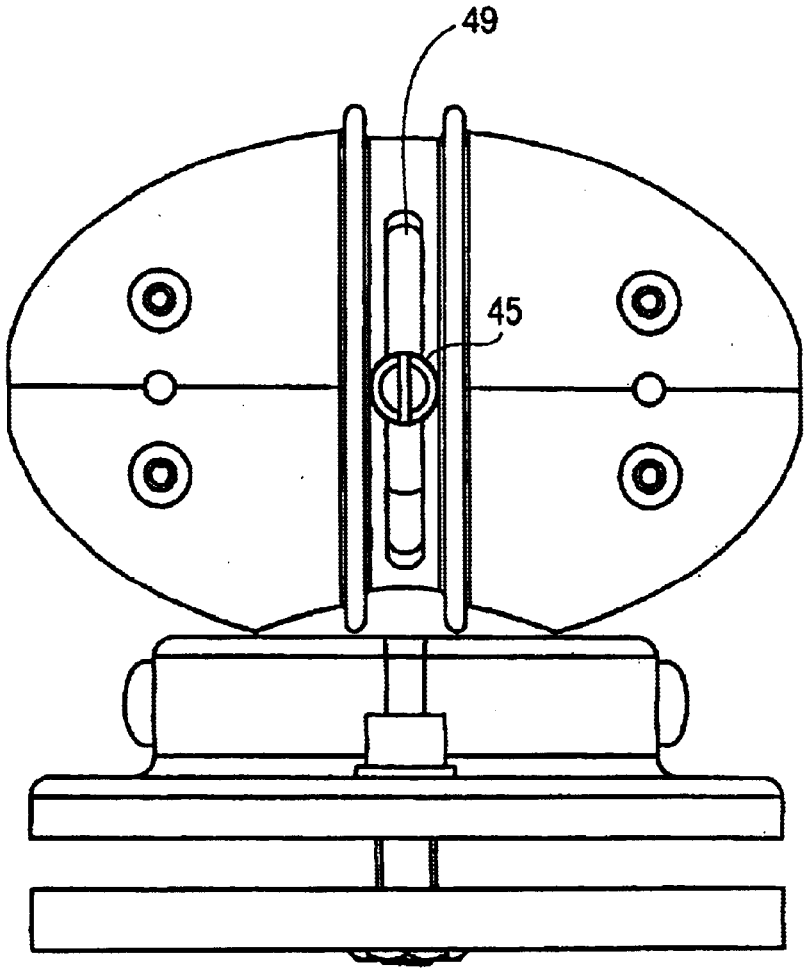
FIG. 3 is a bottom view of the sensor housing attached to the mounting base.

FIG. 3 illustrates a bottom view of the sensor 41 after installation within the mounting base. The illustrated securing-pin head 45 engages the second cover portion 44 within a channel 49 provided on its exterior. The channel 49 allows for setting the angular orientation of the securing pin 46 with respect to the second cover portion 44. Changing the angular orientation repositions the actuator assembly 20 within the sensor cover portions 42, 44 so as to change the angle of the actuator with respect to the level horizontal orientation. By changing the angle of the actuator, the sensor sensitivity is adjusted by varying the starting position of the spherical elements of the actuator assembly, as discussed with further detail below with reference to FIGS. 5, 6 and 7.

Figure 4:
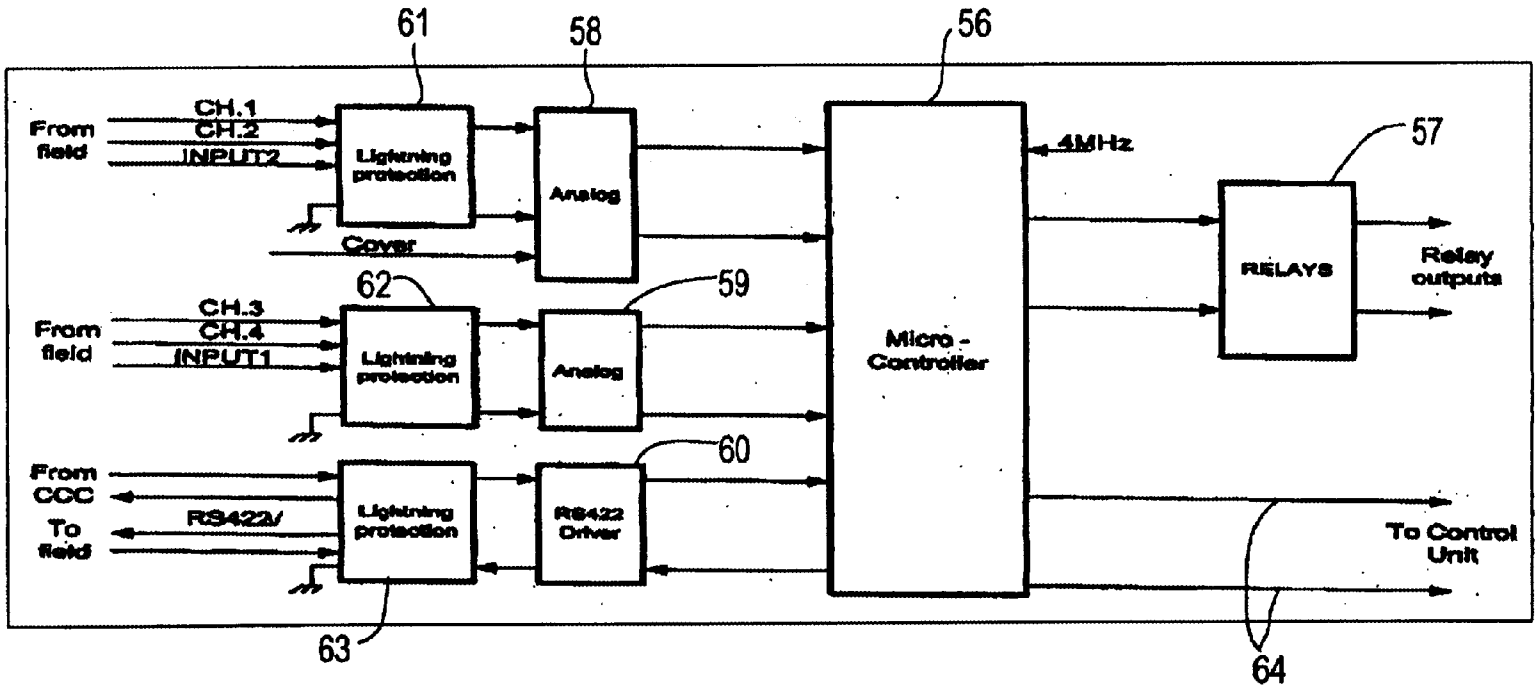
FIG. 4 illustrates an electrical circuit adapted to be employed with the vibration sensor of FIGS. 1, 2, and 3.

FIG. 4 is a simplified illustration of an electrical circuit associated with the sensor of FIG. 1, which is employed to convert mechanical disturbances, applied to the actuator, into electrical signals. The circuit includes a controller, analog receivers, relays, and a communication module. The controller is preferably programmed to execute an analysis algorithm to determine whether an alarm should be indicated by the relays in response to signals from the vibration sensors it monitors. In one embodiment, the algorithm generates an alarm indication when both spherical elements of a single sensor disengage from the respective conductive areas. The controller is advantageously associated with local memory for storing program instruction implementing the control algorithm. The controller receives sensor data from a pair of analog to digital converters. Each analog to digital converter receives signals from two sensors. The controller processes the received data to determine the state of the system. Such signal processing algorithm is apparent to one of ordinary skill in the art. The controller employs the relays to communicate an indication of the system state to a monitoring facility.

Figure 5:
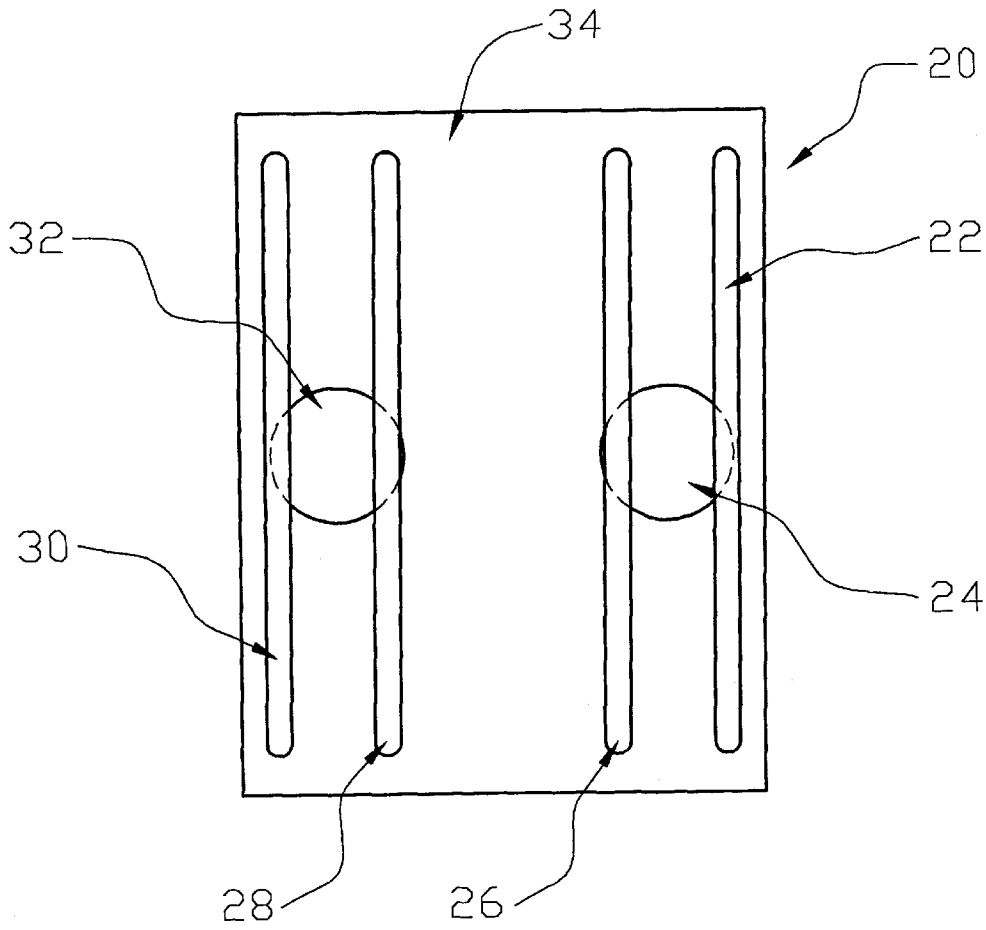
FIG. 5 is a bottom view of the actuator assembly of FIG. 5.
Figure 6:
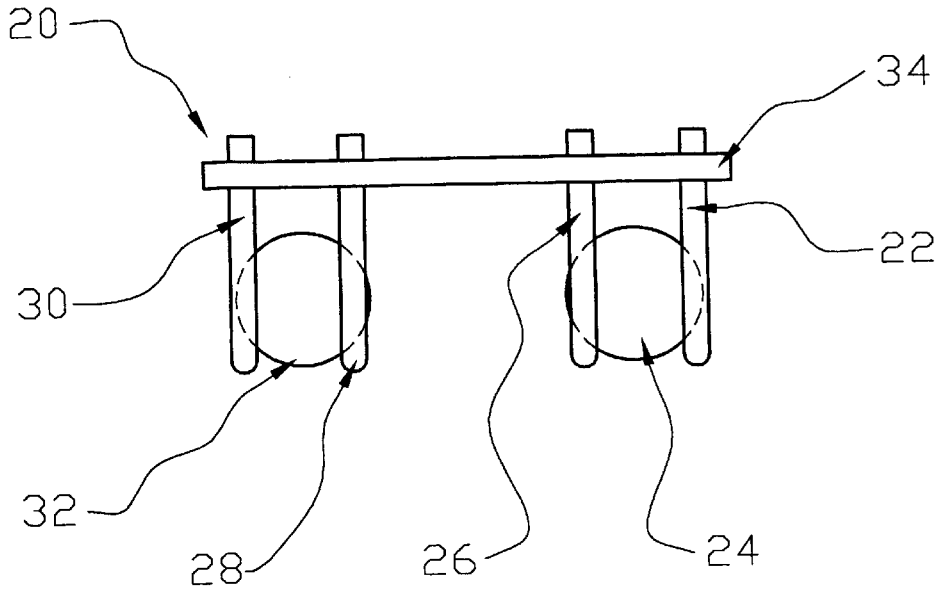
FIG. 6 is a front view of the actuator assembly of FIG. 5.
Figure 7:
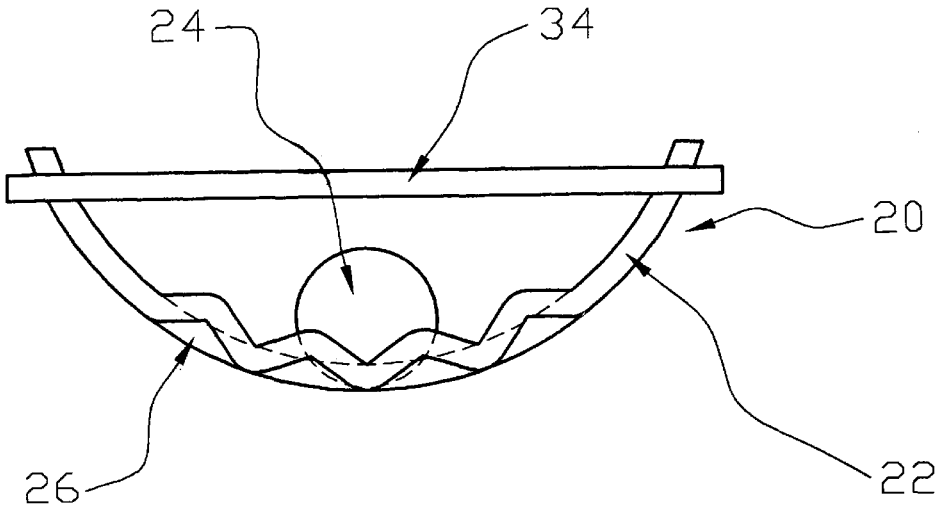
FIG. 7 is a side view of the actuator assembly of FIG. 5.

FIGS. 5, 6, and 7 illustrate various perspective views of the actuator assembly of FIG. 1. As shown in FIGS. 5, 6, and 7 the actuator assembly 20 includes two conductive spheres 24, 32 which rest between a pair of generally parallel conductive arcs 22 and 26, 28 and 30, respectively. Each pair of conductive arcs 22 and 26, 28 and 30, preferably includes one smooth arc 26, 28 located closer to the center of the actuator assembly panel 34, and one irregular arc 22, 30 which is preferably located farther away from the center of the actuator assembly panel. The two pairs of conductive arcs 22, 26 and 28, 30 are preferably coupled to the panel 34 in a slightly protruding manner. Each end of a conductive arc is preferably electrically coupled to a control circuit (not shown) which facilitates the electrical circuit illustrated in FIG. 4. The control circuit is preferably coupled to the actuator assembly panel 34 on the side opposite of the conductive spheres 24, 32.

In operation, the actuator assembly 20 acts to convert mechanical vibrations to electrical signals by translating mechanical disturbances to the conductive spheres into a disturbance of an electrical connection between the arcs, which the spheres provide.

When the sensor is in a stable mechanical state, absent any vibrational effects, the spheres rest in contact between each of the corresponding arcs, thereby providing an electrical connection between the arcs. A mechanical disturbance to the sensor temporarily breaks the connection between the sphere and its corresponding arcs. The break in connection between the sphere and its corresponding arcs temporarily opens the electrical connection between the arcs. The temporary break in the connection is sensed by the control circuit. In one embodiment, an alarm condition is only reported if both spheres of the actuator assembly provide an indication of a mechanical disturbance by breaking contact with both corresponding arcs. In one embodiment, this is provided by connecting the two pairs in parallel. Accordingly, in this embodiment, the use of two sets of spheres and corresponding arcs decreases the number of false alarms reported by the sensor by requiring both sets to simultaneously indicate a mechanical disruption.

In one embodiment, each sphere engages the respective corresponding arcs in at least two points, one on each arc. As may be appreciated, and illustrated in FIG. 7, the irregular arc of each pair serves to increase the number of contact points between the sphere and that arc. Specifically, the corresponding sphere 24 engages the irregular arc 22 over several points on the irregular arc, depending on the shape of the irregularities. As the irregularities are closer together, the sphere 24 engages an increased number of points on the arc 22. The increase in contact points between the sphere 24 and its corresponding arcs 22, 26 serves to decrease the sensitivity of the sensor by increasing the stability of the sphere's resting position between the arcs. Hence, the spheres 24 are less likely to break contact with the corresponding arcs 22, 26 since more connection paths are available to close the corresponding circuit. In one embodiment, the irregularities are v-shaped bends in the arcs.

As may be appreciated, the present invention provides for a directionally-sensitive sensor, which is particularly adapted for mounting on an outdoor fence. The actuator assembly 20 is more likely to react to vibrational disturbances having force vectors perpendicular to the arcs 22, 26 than to disturbances having force vectors parallel to the arcs. Specifically, the sphere 24 is more likely to move away from one of the arcs 22, 26 if it is pushed sideways, or perpendicular to the arcs. Force that is directed parallel to the arcs 22, 26 is more likely to cause the sphere to roll back and forth, without moving away from any of the arcs. Hence, the sensor of the invention is more sensitive in the perpendicular direction than in the parallel direction.

False alarms are often caused by wind, which forces a fence back and forth in a periodic motion. Prior art vibration sensors often produce an alarm condition in response to such wind-caused motion. These false alarms substantially affect system costs and reliability. Conversely, the sensor of the invention is mounted with its arcs 22, 26 perpendicular to the fence or parallel to the wind-caused motion of the fence. Thus, the sensor is less likely to provide an alarm indication by a periodic motion caused by wind, since the spheres will merely roll back and forth instead of breaking contact with the arcs. As may be appreciated, the sensor of the invention can be deployed to monitor other structures affected by other natural disturbances, such as ocean waves for example.

In one embodiment, the arcs of the actuator 20 are non-parallel. The sensor's angular position can be adjusted as discussed with reference to FIG. 3 to change the position of the spheres 24. As may be appreciated, the change in position along the arcs moves the sphere to a position where the arcs are at an increased or decreased spacing. A decrease in spacing increases the sensitivity of the sensor by reducing the stability of the sphere's resting position on top of the arcs. An increase in spacing decreases the sensitivity of the sensor by increasing the stability of the sphere's resting position on top of the arcs. Hence, in one embodiment the sensor is an adjustable sensor providing for variance in sensitivity by an adjustment of angular position after installation. As may be appreciated, allowing for the adjustment of the actuator after installation provides substantial benefits such as when an installed system is over-sensitive and produces an unbearable number of false alarms, thereby rendering the system useless for its intended purpose. In other instances where the system is determined to be under-sensitive, where desired vibrations are not detected, the sensitivity of certain sensors can be increased to accommodate for the under-sensitivity. In yet another embodiment, the adjustment feature is employed to properly align the actuator when parallel arcs are deployed, to ensure that the sphere is centered to the arcs.

Although the present invention was discussed in terms of certain preferred embodiments, the invention is not limited to such embodiments. A person of ordinary skill in the art will appreciate that numerous variations and combinations of the features set forth above can be utilized without departing from the present invention as set forth in the claims. Thus, the scope of the invention should not be limited by-the preceding description but should be ascertained by reference to claims that follow.

I claim:

1. A vibration sensor to be employed for detecting movement of a physical barrier, the vibration sensor comprising:

a sensor cover, the sensor cover including a coupling portion for coupling the sensor to a physical barrier at a first orientation, the sensor cover adapted to secure an actuator assembly in at least one predetermined orientation relative to the level horizontal when the sensor is coupled to the physical barrier at said first orientation;

an actuator assembly comprising:

a first pair of conductive arcs and a second pair of conductive arcs, each pair of conductive arcs is coupled as a corresponding ends of a switch to a control circuit, the first pair of conductive arcs is positioned substantially parallel to the second pair of conductive arcs; and a first conductive sphere and a second conductive sphere, the first sphere resting between and engaging each arc from said first pair of conductive arcs to provide an electrical connection between the first pair of conductive arcs and the second sphere resting between and engaging each arc from said second pair of conductive arcs to provide an electrical connection between the second pair of conductive arcs; and a control circuit coupled to at least each arc of the first pair of conducive arcs and the second pair of conductive arcs, the control circuit indicating an alarm to a sensor output in response to a break in the electrical connection between arcs of a pair of conductive arcs.

2. The sensor of claim 1, wherein the first sphere and the second sphere are configured to rest between the corresponding arcs at a predetermined orientation, the predetermined orientation associated with a first stability to force parallel to the pair of arcs and a second stability to force perpendicular to the pair of arcs, the first stability is greater than the second stability, whereby the corresponding sphere is more likely to disengage from the corresponding arcs by force perpendicular to the associated pair of arcs than by force parallel to the associated pair of arcs.

3. The sensor of claim 1, wherein the first pair of conductive arcs and the second pair of conductive arcs are 180 degree arcs with constant curvature.

4. The sensor of claim 1, wherein the first pair of conductive arcs and the second pair of conductive arcs are extruded copper wire elements.

5. The sensor of claim 1, wherein the first pair of conductive arcs and the second pair of conductive arcs are uniformly spaced apart.

6. The sensor of claim 1, wherein the first pair of conductive arcs and the second pair of conductive arcs are associated with a constant taper spacing from a maximum spacing to a minimum spacing.

7. The sensor of claim 1, wherein at least one arc of the first pair of conductive arcs and at least one arc of the second pair of conductive arcs includes irregularities to increase the number of contact points between said at least one arc and the conductive sphere resting on said at least one arc and the second arc of the pair.

8. The sensor of claim 7, wherein the irregularities are uniformly spaced triangular bends in the arc.

9. The sensor of claim 1, wherein the sensor cover further comprises a securing pin for securing the actuator assembly to the sensor cover at a plurality of orientations relative to the level horizontal when the sensor is coupled to the physical barrier at said first orientation.

10. The sensor of claim 9, wherein the position of said securing pin within the sensor cover is adapted for adjustment after securing the sensor to the physical barrier without removing the sensor from the physical barrier to adjust the actuator assembly orientation relative to the level horizontal.

11. The sensor of claim 1, further comprising a mounting base, a first end of said mounting base is configured to be secured to the physical barrier, a second end of said mounting base is configured to removably couple to the sensor cover by at least a plurality of securing bolts.

12. The sensor of claim 11, wherein the mounting base further comprises a coupling channel, and further wherein the sensor cover further comprises a coupling ring, the coupling channel adapted to receive the coupling ring at an orientation whereby the actuator assembly within the sensor cover is substantially skewed from the level horizontal whereby both conductive spheres disengage the electrical connection between the corresponding arcs.

* * * * *